US011243009B2

(12) United States Patent
Carlens et al.

(10) Patent No.: US 11,243,009 B2
(45) Date of Patent: Feb. 8, 2022

(54) DEVICE FOR PREHEATING A FLUID, IN PARTICULAR COOLANT FOR A COMBUSTION ENGINE

(71) Applicant: Nino Volante, Eschweiler-Wiltz (LU)

(72) Inventors: Jean-Claude Carlens, Manhay (BE); Jean-François Zune, Gouvy (BE)

(73) Assignee: Nino Volante, Eschweiler (LU)

( * ) Notice: Subject to any disclaimer, the term of this patent is extended or adjusted under 35 U.S.C. 154(b) by 995 days.

(21) Appl. No.: 14/782,278

(22) PCT Filed: Apr. 1, 2014

(86) PCT No.: PCT/EP2014/056502

§ 371 (c)(1),
(2) Date: Oct. 2, 2015

(87) PCT Pub. No.: WO2014/161839

PCT Pub. Date: Oct. 9, 2014

(65) Prior Publication Data

US 2016/0054029 A1 Feb. 25, 2016

(30) Foreign Application Priority Data

Apr. 3, 2013 (BE) ..... 2013/0233

(51) Int. Cl.

| | |
|---|---|
| ***F24H 1/14*** | (2006.01) |
| ***F24H 1/12*** | (2006.01) |
| ***H05B 3/20*** | (2006.01) |

(52) U.S. Cl.

CPC ..... *F24H 1/142* (2013.01); *F24H 1/121* (2013.01); *H05B 3/20* (2013.01); *H05B 2203/02* (2013.01);

(Continued)

(58) Field of Classification Search

CPC . F24H 1/10; F24H 1/101; F24H 1/102; F24H 1/105; F24H 1/12; F24H 1/121;

(Continued)

(56) References Cited

U.S. PATENT DOCUMENTS

| | | | | |
|---|---|---|---|---|
| 3,782,456 A | | 1/1974 | Gusmer | |
| 6,093,909 A | * | 7/2000 | Beetz | B60H 1/2221 219/202 |

(Continued)

FOREIGN PATENT DOCUMENTS

| | | |
|---|---|---|
| DE | 2942523 A1 | 4/1981 |
| EP | 0899985 A1 | 3/1999 |

(Continued)

OTHER PUBLICATIONS

International Search Report dated Jun. 14, 2014 from counterpart PCT App. No. PCT/EP2014/056502.

(Continued)

*Primary Examiner* — Justin C Dodson
(74) *Attorney, Agent, or Firm* — James E. Walton

(57) ABSTRACT

The invention relates to a device for heating a fluid (2), comprising a heating body (4) having a through passageway (6, 8) for the fluid and provided with at least one groove (14) on its outer surface; at least one electrical resistance (24) housed in the at least one groove (14) of the heating body. The device further comprises at least one closure plate (20) of the at least one groove (14) overlying the at least one resistance (24).

14 Claims, 2 Drawing Sheets

(52) U.S. Cl.
CPC .... *H05B 2203/022* (2013.01); *H05B 2214/03* (2013.01)

(58) Field of Classification Search
CPC .. F24H 1/14; F24H 1/142; H05N 3/20; H05N 3/22; H05N 3/24; H05N 3/32; H05N 3/40; F02N 19/02; F02N 19/04; F02N 19/10; F01M 5/021; F01P 11/20; H05B 2203/02; H05B 2203/022; H05B 2214/03; H05B 3/20
USPC ..... 392/465, 468, 478, 479, 480, 482, 483, 392/485, 486, 487, 488, 490, 484; 123/142.5 E
See application file for complete search history.

(56) References Cited

U.S. PATENT DOCUMENTS 6,330,395 B1 * 12/2001 Wu ..... F24H 1/14 392/484
6,816,670 B1 11/2004 Renau
8,170,406 B2 * 5/2012 Wu ..... B60S 1/487 392/465
2007/0274697 A1 * 11/2007 Commette ..... F24H 1/102 392/484
2008/0000889 A1 * 1/2008 Niederer ..... F24H 3/0464 219/205
2009/0317068 A1 * 12/2009 Yeung ..... F24H 1/106 392/449

FOREIGN PATENT DOCUMENTS

EP 2562016 A1 2/2013
WO 2004038303 A2 5/2004

OTHER PUBLICATIONS

Written Opinion dated Oct. 3, 2015 from PCT App. No. PCT/EP2014/056502.

* cited by examiner

DEVICE FOR PREHEATING A FLUID, IN PARTICULAR COOLANT FOR A COMBUSTION ENGINE

TECHNICAL FIELD

The invention relates to a device for heating a fluid, more particularly a coolant of an internal combustion engine. The present invention also relates to a fluid heating process for various applications.

The fluids may be sanitary water, chlorinated water, water with glycol, hydrocarbons (diesel, gasoline, oil, . . . ), vegetable oils (colza), gases in liquid or gaseous state, . . . .

Examples of heating applications are numerous: industrial, generators, cogeneration groups, combustion engines (petrol, diesel, LPG, . . . ), pools, spas, hot water, aquariums, ponds, . . . .

PRIOR ART

The engines of emergency generators (hospitals, enterprises, . . . ) must be maintained at a temperature (~40° C.) that is ideal for a direct starting thereof, to ensure within a few second electricity supply in the event of mains failure.

The engines of emergency vehicles (ambulances, fire brigade, . . . ) should also be heated beforehand to ensure an immediate start in the best conditions to ensure their interventions.

The engines of special vehicles can also be heated prior their starting in order to not only start in good conditions, but also to improve passenger comfort, with a warm interior directly and/or through defrosted or defogged windows. Numerous studies have demonstrated a beneficial effect on the reduction of fuel consumption as well as the reduction of pollution at startup using such a heater.

Manufacturers offer on the market heaters powered by external electrical power and which operate on the principle of thermosiphon. The heating element is directly immersed in the heating body, or in the water chambers of the engine and thus directly in contact with the fluid. To reduce its size, the specific load per $cm^2$ is very high, which makes such heaters unreliable devices in time. The yield thereof is very low and the placement on the circuit is not easy to allow for thermal movement. For over ten years, engine manufacturers have significantly changed the design of the water chambers in engines and it becomes difficult to place this type of heater because this configuration does no longer render possible to create an effective flow through this thermosiphon principle and so to properly and uniformly heat the engines.

Others offer devices with a circulation pump. The heating element (immersion heater) is also directly immersed in water. The yield is significantly higher compared with the process by thermosiphon. However, the size is still too high to allow easy placement on mid-sized vehicles (passenger cars, ambulances, trucks . . . ). In addition, commonly used pumps must be positioned horizontally, which further reduces the possibilities of integration under the bonnet. The only possibility would be to reduce the size of such devices by decreasing the length of the heating element. This solution would affect reliability because they would come out of the usual standards provided by the manufacturers for the maximum specific load of the heating elements for this type of fluid. This would cause a boiling of the fluid at the heating element that would result in a degradation of the shield thereof, and then lead to a premature rupture of the element.

The patent document WO 2011/016763 A1 discloses a preheater for the coolant of an internal combustion engine. It essentially comprises a main body with an interior volume, an inlet, an outlet, and a heating element disposed in the interior of the main body. The heating element itself comprises an internal volume in which are disposed one or more electrical resistances of the positive temperature coefficient type (PTC acronym for "Positive Temperature Coefficient"). This preheater has the advantage of being of a relatively simple construction. The thermal connection between the resistances and the fluid is, however, not optimal. In addition, the main body is subject to significant losses to the atmosphere. The thermal efficiency of this device is therefore not optimal. This system seems to work on the principle of thermosiphon, which limits the heating performance.

The patent document DE 102 58 257 A1 also discloses a preheater for a fluid of a combustion engine, such as for example fuel, lubricant or coolant. It essentially comprises an elongated main body with a fixing flange. The main body is intended to be immersed in the fluid and the flange ensures a tight mounting on a wall. The main body includes various elements including a frame, a conductive sheet and heating elements of the Positive Temperature Coefficient PTC type. This preheating device has the same disadvantage as that of the document cited above, namely that the thermal contact between the heating elements and the fluid is not optimized. This system seems to work on the principle of thermosiphon, which limits the heating performance.

The WO 01/33071 A1 discloses a method of preheating an engine and a device for implementing said method. The method essentially consists in providing a heating element such as an electric resistance in a tank separate from the engine and containing the engine coolant. The electrical resistance of the spiral type is in direct contact with the fluid. This direct contact is not desirable for some applications. In addition, the overall size of the device is fairly large and may pose integration problems. This system seems to work on the principle of thermosiphon, which limits the heating performance.

Patent document U.S. Pat. No. 4,371,777 relates to a fluid heating body, forming a U-shaped circuit comprising heating elements of the PCT type. These are arranged in the cavity of the U, the U being formed by a bent tube provided with two solid elements conforming the tube and between which the PTC elements are arranged. Alternatively, the heating body can include two solid elements disposed one against the other via a seal at the fluid passage for sealing. A cap in two parts is provided. The power of heat exchange is limited in this teaching, especially because of the limited diameter of the curved pipe and the limited number of heating elements.

The patent document DE 200 20 347 U shows a heating body with a straight passage for a fluid and a housing for a ceramic heater element. The heat exchange power is very limited.

The patent document GB 2 079 421 A shows a heating body, especially for hot drinks dispensers, inside a mold containing U-shaped channels, and electrical resistances arranged outside of the U-shaped path. Due to the remoteness of the electrical resistances vis-a-vis of the U-shaped channels, the heat exchange power is limited.

Patent document GB 2 014 417 A shows a heating body having a triple U-shaped passage with electric resistances housed in grooves extending in the cavities of the U-profiles of the passage. The electric resistances extend perpendicular to the main plane of the heating body. In this teaching, the heat exchange between the resistance and the fluid is performed in three different locations, thereby increasing system efficiency. However, the thermal exchange takes place mainly in the middle of the path followed by the fluid and a risk of heat loss at the outlet location of the fluid is present.

The patent document DE 87 01 656 U discloses a heating device with a U-shaped passage and an open groove extending along the U-shaped profile, said groove accommodating an electrical resistance. The passage must have a certain length for the fluid to reach the desired temperature.

SUMMARY OF THE INVENTION

Technical Problem

The invention aims to provide a fluid heating device which overcomes at least one of the above mentioned disadvantages. More particularly, the invention aims to provide a fluid heating device having improved thermal efficiency and being of simple and economical construction. More particularly, the invention aims to provide a compact fluid heating device with a simple and inexpensive construction.

Technical Solution

The invention relates to a device for heating a fluid, comprising: a heating body having a through passageway for the fluid and provided with at least one groove on its outer surface; at least one electrical resistance housed in the at least one groove of the heating device; characterized in that it further comprises at least a closure plate of the at least one groove, covering the at least one resistance.

The cross section of the at least one groove preferably has a constant profile over a major portion of its length.

According to an advantageous embodiment of the invention, the width of the at least one groove is greater than its height, and this on the majority of its length.

According to an advantageous embodiment of the invention, the ratio between the width and height of the groove is greater than 2, preferably 3, more preferably 5.

According to an advantageous embodiment of the invention, the at least one resistance is generally elongated and flat.

According to an advantageous embodiment of the invention, the at least one closure plate extends beyond the at least one electrical resistance and/or beyond the at least one groove, so as to bear against the heating body.

According to an advantageous embodiment of the invention, the at least one closure plate is adapted to be secured to the heating body by screwing.

According to an advantageous embodiment of the invention, the at least one plate comprises orifices along its edges and the heating body comprises threaded bores for receiving fastening screws arranged through said orifices.

According to an advantageous embodiment of the invention, the at least one closure plate is in contact with the at least one electrical resistance. Some pressure between the resistance(s) and the plate(s) may be provided to ensure intimate contact and optimum thermal conduction. This pressure may be higher or equal to 10 Pa, preferably 100 Pa, more preferably 1000 Pa.

According to an advantageous embodiment of the invention, the passageway through the heating body is essentially straight.

According to an advantageous embodiment of the invention, the passageway through the heating body includes several parallel longitudinal channels.

According to an advantageous embodiment of the invention, at least one of the longitudinal channels opens on at least one face of the heating body, preferably on two opposite faces, the said face(s) being provided with plug(s) closing the areas where said channels open. Preferably, all of the longitudinal channels open on both faces in question.

According to an advantageous embodiment of the invention, the at least one face of the heating body on which at least one of the longitudinal channels opens are provided, at the areas where said channel(s) open, with a connector for a hydraulic connection of the device. The device preferably includes three longitudinal channels, the connectors being aligned with the central channel and the plugs being aligned with two lateral channels. Similarly, the device may comprise five longitudinal channels, the central one corresponding to the connectors and the lateral ones with the plugs.

According to an advantageous embodiment of the invention, the groove and the at least one electrical resistance extend transversely over the entire longitudinal channels.

According to an advantageous embodiment of the invention, the passageway through the heating body comprises a transverse channel disposed on at least one or both ends of the parallel longitudinal channels, ensuring a connection of said channels.

According to an advantageous embodiment of the invention, the at least one transverse channel opens on one side of the heating body, said face being provided with plug(s) for closing the area(s) where said channel(s) open(s).

According to an advantageous embodiment of the invention, the at least one channel is produced by drilling, electro erosion and/or extrusion.

According to an advantageous embodiment of the invention, the longitudinal channels are formed directly during the manufacture of the body by extrusion and the transverse channels are formed by removing material, for example by drilling and/or machining.

According to an advantageous embodiment of the invention, the heating element is an integral block generally parallelepipedic.

According to an advantageous embodiment of the invention, the heating element comprises two grooves on opposite faces of said body, the passageway extending between said faces and said grooves.

According to an advantageous embodiment of the invention, the at least one electric resistance is of the PTC type.

The invention also relates to a combustion engine equipped with a heating device for the coolant, remarkable in that the device is according to the invention.

The invention also relates to a preheating method of the coolant of an internal combustion engine with a heating device, remarkable in that the device is according to the invention.

Benefits of the Invention

The measures of the invention have the advantage of optimizing the thermal efficiency, specifically by increasing the efficiency of heat exchange between the at least one heating resistance and the fluid, and also by reducing losses in the atmosphere. Indeed, the construction of the heating body and the arrangement of the resistances according to the invention allows an intimate contact between the resistances and the fluid. The at least one heating resistance indeed extends along the major part of the fluid path as they are arranged in parallel along the main direction of the passageway. Dividing the passageway into several longitudinal channels increases the heat transfer for a given length of the passageway. Electric resistances can be supplied with 110, 230, 400 or 480 VAC (typically on the home network) during engine preheating while the vehicle is stationary. One or more additional resistances can be supplied with voltage 12 or 24 VDC by the vehicle battery to continue heating when the engine is running. The compact and geometric shape of the heating body makes it easy to isolate by equipping it with an insulating coat. The latter may be provided removable, which is made easy again by the optimized shape of the heating body. The heating body can be performed at low cost from a block of material such as aluminum with some conventional and controlled machining operations.

DESCRIPTION OF EMBODIMENTS

Figure 1:
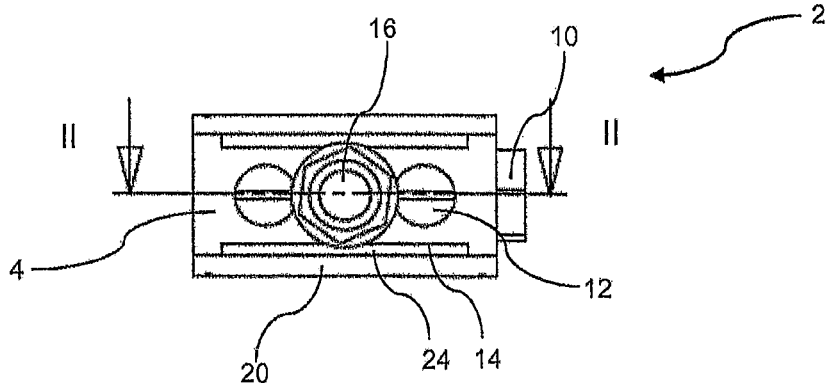
FIG. 1 is a representation of the transverse face of the heating device according to the invention.
Figure 2:
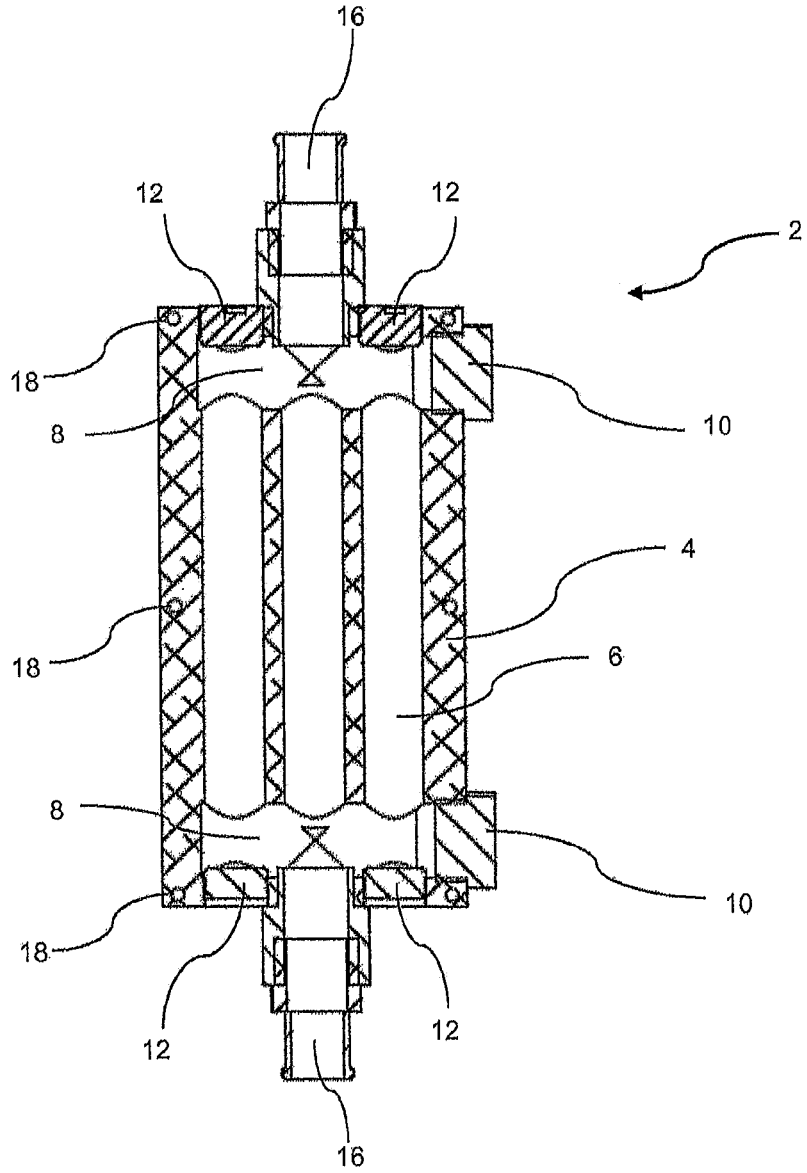
FIG. 2 is a sectional view II-II of the heating device of FIG. 1.
Figure 3:
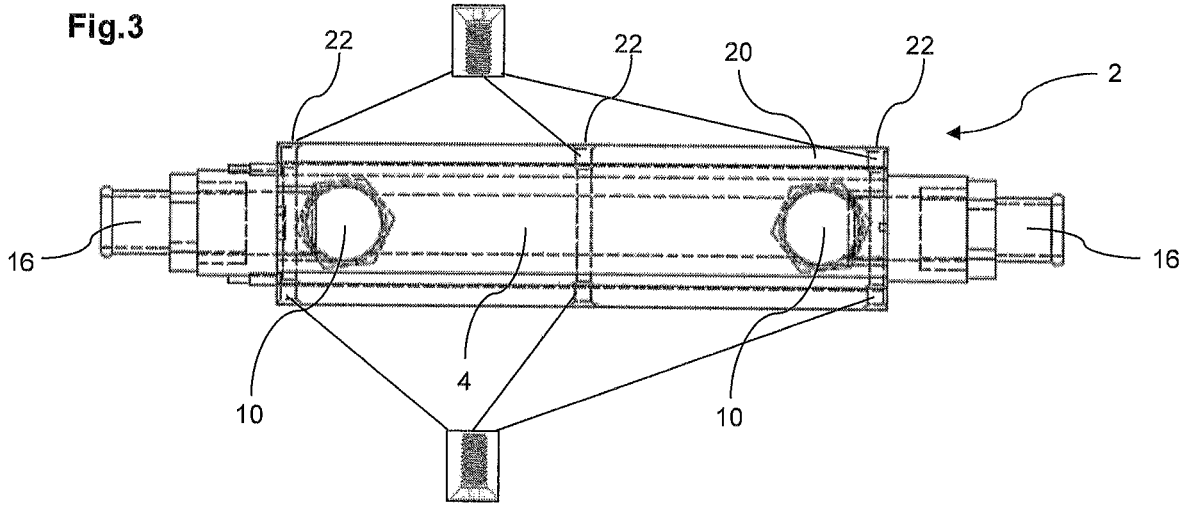
FIG. 3 is a view of the longitudinal side, on the side of the plugs, of the heating device of FIGS. 1 and 2.

The fluid heating or preheating device shown in FIGS. 1 to 3 essentially comprises a solid member 4 of generally rectangular section having a through passageway for the fluid. The passageway comprises three straight and parallel channels 6 passing through the block from side to side. These channels are preferably produced by drilling.

The passageway also comprises two transverse channels 8, each being near one of the two ends of the longitudinal channels 6. These channels have the function to ensure a placing in communication of the longitudinal channels. These transverse channels are preferably made by drilling.

The heating body 4 can be made by extrusion with the longitudinal channels. The transverse channels can then be made by machining.

The longitudinal channels 6 open out on the front and back of the body 4. The areas of these faces where the lateral channels open are fitted with plugs 12, while the areas of said faces where the central channel opens are provided with fittings or connectors 16 for a hydraulic or gas connection of the device. These fittings may in particular be of the type with hose barb for engaging a hose by insertion. The plugs 12 and/or fittings 16 are preferably of the type with external thread cooperating with a female thread formed in the body 4.

The transverse channels 8 open only on one of the side faces of the body 4. The areas of said face where these channels open are provided with a plug 10. The plugs 10 are preferably of the type with a male thread cooperating with female thread formed in the body 4.

The body 4 comprises two grooves 14 on the longitudinal sides of the body 4 extending along the longitudinal channels 6. The grooves 14 have a width substantially greater than their height, for example in a ratio greater than 2, preferably 3 more preferably 5. Each groove 24 accommodates an electrical resistance generally flat and extended. A closure plate 20 covers each of the grooves 14 and the corresponding resistance. Each of the resistances 24 covers, along the width of the body, all of the longitudinal channels 6. They also cover them substantially completely along the length of the body 4.

Each of the two plates 20 extends transversely beyond the groove so as to have its lateral edges (corresponding to the longitudinal direction of the device) in contact with the body 4. To that end, orifices 22 are provided therein for receiving fastening screws (not shown) engaging with corresponding threaded bores 18 of the body 4.

The electrical resistances used as of the PTC type (Positive Temperature Coefficient acronym). Depending on the temperature, a balance between the thermal flux generated by the PTC resistance and the heat dissipation to the environment is created. Heat dissipation is maximized by the provision of electrical resistances along the fluid passage, the temperature of the ceramic component of the PTC resistance will decrease which will ensure to increase the electrical power via an increase of the current intensity. The power absorbed by the fluid is dependent on the ambient temperature, the fluid temperature and the flow rate of the pump circulating the fluid.

The PTC electric resistances can run dry without risk of breakdown. Without thermostat and security, they will automatically stabilize at their set point temperature. In addition, these resistances can operate by being supplied with different voltages (110-240 V) and frequencies (50-60 Hz).

The PTC electric resistances have the advantage that they can be heated without regulation thermostat without causing breakdown, as would be the case for shielded heating elements standard type. In addition, the PTC, electric resistances are used to withstand cold and hot electrical insulation tests whereas standard electrical resistances are normally tested in cold conditions as they can deteriorate in hot conditions.

The PTC electrical resistances are self-regulating resistances, which increases the load per unit area without the risk of overheating.

Compared to a standard electrical resistance, and for the same power, the bulk volume of the PTC electrical resistance is nearly 80% lower. This significant reduction in volume allows the use of elongated electric resistance and flat and insert them at the solid element of the heating device or preheating described above.

In order to guarantee minimal heat dissipation, a cap having a thermal insulation may be provided. It may cover the body of the device and is secured thereto by connecting means which have been disposed on the longitudinal ends of the body.

The heating body is in the form of a rectangular parallelepiped. It can be made of aluminum, brass, stainless steel or other conductive material of the heat, depending on the intended application.

The internal volume of the solid element has been shaped so as to accommodate different channels, favoring the passage of fluid according to a predominantly longitudinal direction while maximizing the heat exchange with the PTC electrical resistances through the presence of several longitudinal channels communicating with each other via transverse channels.

With regard to combustion engines and, in particular for vehicles and generators, one or more PTC electric heating resistances are placed within the body and are powered by the battery 12 or 24 VDC which allows, depending the application to continue the heating when the device is no longer supplied with 110-230 V. These combustion engines or these generators, thus continue the heating, which allows the engine to reach faster to temperature ideal operation.

Depending on the various applications and fluid to be heated, the circulation pump is adapted.

The invention claimed is:

1. A heating device for heating a fluid, comprising:

a heating body having a through passageway for the fluid with:

a plurality of parallel longitudinal channels;

at least one groove formed on an outer surface of the heating body, said outer surface extending along the plurality of parallel longitudinal channels;

at least one electrical resistance housed in the at least one groove of the heating body; and at least one closure plate of the at least one groove overlying the at least one electrical resistance and extending along the plurality of parallel longitudinal channels and extending transversely, in each of two opposed transverse directions, beyond the groove so as to have two lateral edges in direct contact with the body, wherein each of the two lateral edges is fastened to said body by fastening screws at said lateral edge;

wherein the passageway passing through the heating body comprises:

a transverse channel formed in the heating body at each of both ends of the plurality of parallel longitudinal channels, ensuring at each of said both ends a direct connection of all of said plurality of parallel longitudinal channels.

2. The heating device according to claim 1, wherein the width of the at least one groove is greater than the height of said at least one groove on a majority of the length of said at least one groove.

3. The heating device according to claim 2, wherein a ratio between the width and height of the at least one groove is greater than 3.

4. The heating device according to claim 1, wherein the at least one electrical resistance is elongated and flat.

5. The heating device according to claim 1, wherein the at least one closure plate bears on the heating body.

6. The heating device according to claim 1, wherein the at least one closure plate comprises:

orifices along the lateral edges of said at least one closure plate and the heating body comprises:

threaded bores for receiving the fastening screws of the fixation by screwing, said fastening screws being arranged through said orifices.

7. The heating device according to claim 1, wherein the at least one closure plate is in contact with the at least one electrical resistance.

8. The heating device according to claim 1, wherein the passageway passing through the heating body is straight.

9. The heating device according to claim 1, characterized in that the at least one groove and the at least one electrical resistance extend transversely over all of the plurality of longitudinal channels.

10. The heating device according to claim 1, wherein each of the transverse channels is produced by drilling.

11. The heating device according to claim 1, wherein the plurality of longitudinal channels and the body are formed by extrusion and the at least one transverse channel is formed by removing material.

12. The heating device according to claim 1, wherein the heating body is an integral solid block that is parallelepipedic.

13. The heating device according to claim 1, wherein:

the at least one groove comprises two grooves on opposite sides of the heating body, the passageway extending between said opposite sides and said two grooves.

14. The heating device according to claim 1, wherein the at least one electrical resistance is a PTC heater.

* * * * *